US011801915B2

(12) United States Patent
Hovde et al.

(10) Patent No.: US 11,801,915 B2
(45) Date of Patent: Oct. 31, 2023

(54) DUAL AXES CONNECTION DEVICE

(71) Applicant: APL Norway AS, Kolbjornsvik (NO)

(72) Inventors: Geir Olav Hovde, His (NO); Anders Vaalandsmyr, Froland (NO)

(73) Assignee: APL NORWAY AS, Kolbjørnsvik (NO)

( * ) Notice: Subject to any disclaimer, the term of this patent is extended or adjusted under 35 U.S.C. 154(b) by 212 days.

(21) Appl. No.: 17/252,468

(22) PCT Filed: Jun. 17, 2019

(86) PCT No.: PCT/NO2019/000021
§ 371 (c)(1),
(2) Date: Dec. 15, 2020

(87) PCT Pub. No.: WO2019/245379
PCT Pub. Date: Dec. 26, 2019

(65) Prior Publication Data

US 2021/0188401 A1 Jun. 24, 2021

(30) Foreign Application Priority Data

Jun. 19, 2018 (NO) ..... 20180854

(51) Int. Cl.
*B63B 21/04* (2006.01)
*B63B 21/20* (2006.01)
(Continued)

(52) U.S. Cl.
CPC ..... *B63B 21/04* (2013.01); *B63B 21/20* (2013.01); *B63B 21/22* (2013.01); *B63B 21/50* (2013.01); *B63B 21/16* (2013.01)

(58) Field of Classification Search
CPC ..... B63B 21/04; B63B 21/20; B63B 21/22; B63B 21/50; B63B 21/16; B63B 21/507;
(Continued)

(56) References Cited

U.S. PATENT DOCUMENTS 5,845,893 A 12/1998 Groves
6,439,146 B2 8/2002 Seaman et al.
(Continued)

FOREIGN PATENT DOCUMENTS

WO WO 2001/051344 7/2001
WO WO 2015/199611 12/2015
(Continued)

OTHER PUBLICATIONS

International Search Report in International Application No. PCT/NO2019/000021, dated Oct. 2, 2020.
(Continued)

*Primary Examiner* — Anthony D Wiest
(74) *Attorney, Agent, or Firm* — Leydig, Voit & Mayer, Ltd.

(57) ABSTRACT

A dual axes connection device for use with a mooring line, a line guide and pulling means for connecting a floating body and a fixed body is provided. The connecting device comprises a dual axes hinge unit, with orthogonal rotational axes x and y, comprising means for fastening the unit to the floating or fixed body, a connecting link fastened to the hinge unit comprising two parallel arms, a funnel connected to the two parallel arms enveloping the mooring line, and locking means for locking the mooring line to the funnel. The mooring line, the line guide and connection device are positioned in one plane.

8 Claims, 9 Drawing Sheets

(51) Int. Cl.
*B63B 21/22* (2006.01)
*B63B 21/50* (2006.01)
*B63B 21/16* (2006.01)

(58) Field of Classification Search
CPC ... B63B 2021/203; B63B 21/10; B63B 21/18; B63B 21/08
See application file for complete search history.

(56) References Cited

U.S. PATENT DOCUMENTS

| | | | |
|---|---|---|---|
| 6,817,595 | B1 | 11/2004 | Jenkins et al. |
| 7,240,633 | B2 | 7/2007 | Barlow |
| 7,926,436 | B2 | 4/2011 | Boatman et al. |
| 9,764,799 | B2 | 9/2017 | Hooper |
| 10,167,059 | B2 | 1/2019 | Askestad |
| 10,377,448 | B2 | 8/2019 | Smith et al. |
| 2001/0029878 | A1 | 10/2001 | Seaman et al. |
| 2002/0189522 | A1 | 12/2002 | Dove et al. |
| 2010/0175604 | A1 | 7/2010 | Boatman et al. |
| 2012/0031320 | A1 | 2/2012 | Bauduin et al. |
| 2012/0160146 | A1 | 6/2012 | Miller et al. |
| 2014/0339485 | A1 | 11/2014 | Busson |
| 2016/0137267 | A1 | 5/2016 | Hooper |
| 2017/0174293 | A1 | 6/2017 | Taylor |
| 2017/0225749 | A1 | 8/2017 | Smith et al. |

FOREIGN PATENT DOCUMENTS

| | | |
|---|---|---|
| WO | WO 2016/001673 | 1/2016 |
| WO | WO 2016/068717 | 5/2016 |
| WO | WO 2016/118006 | 7/2016 |

OTHER PUBLICATIONS

Norwegian Search Report in Application No. 20180854, dated Jan. 18, 2019.

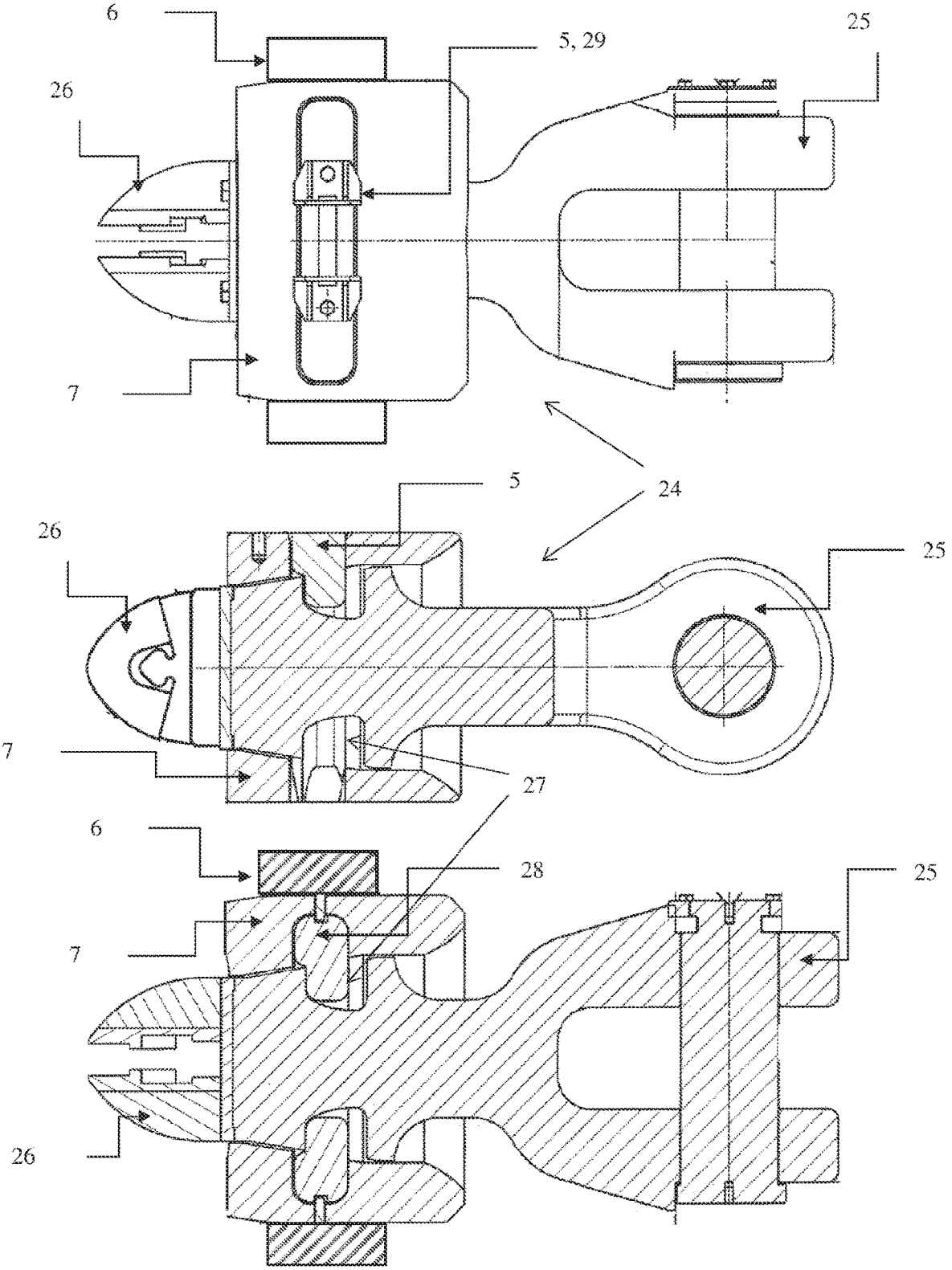
Fig. 6a, b and c

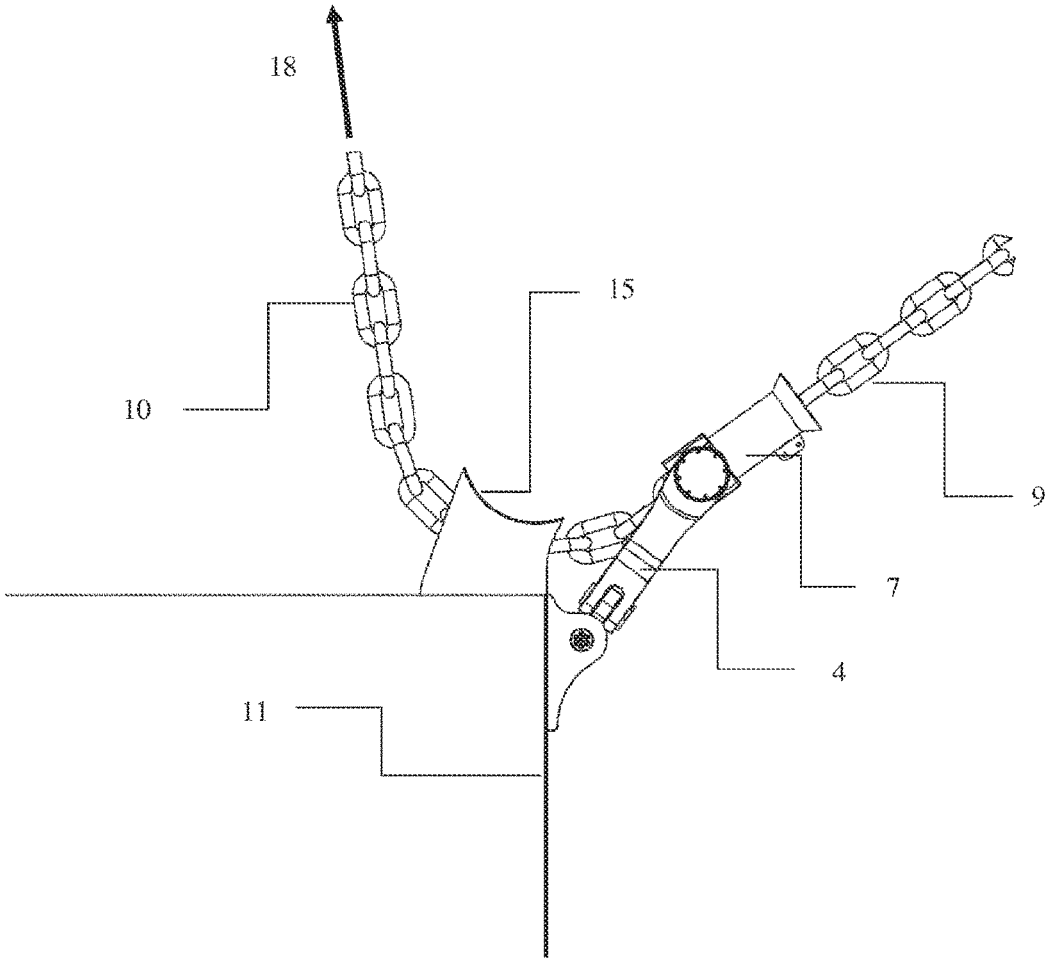
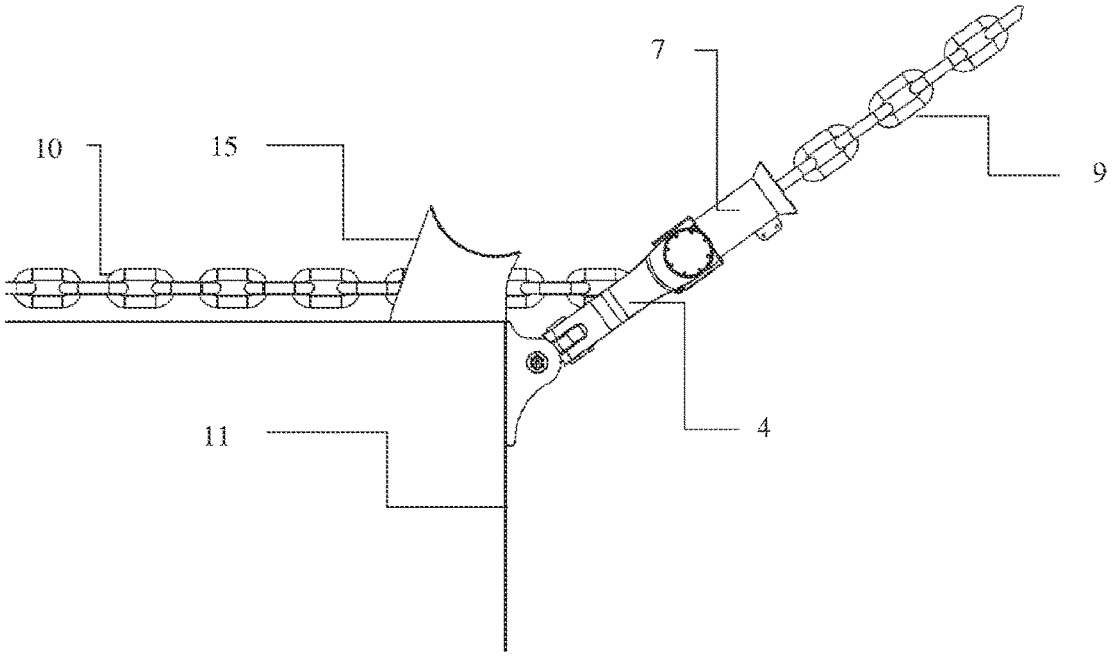
Fig. 7a and b

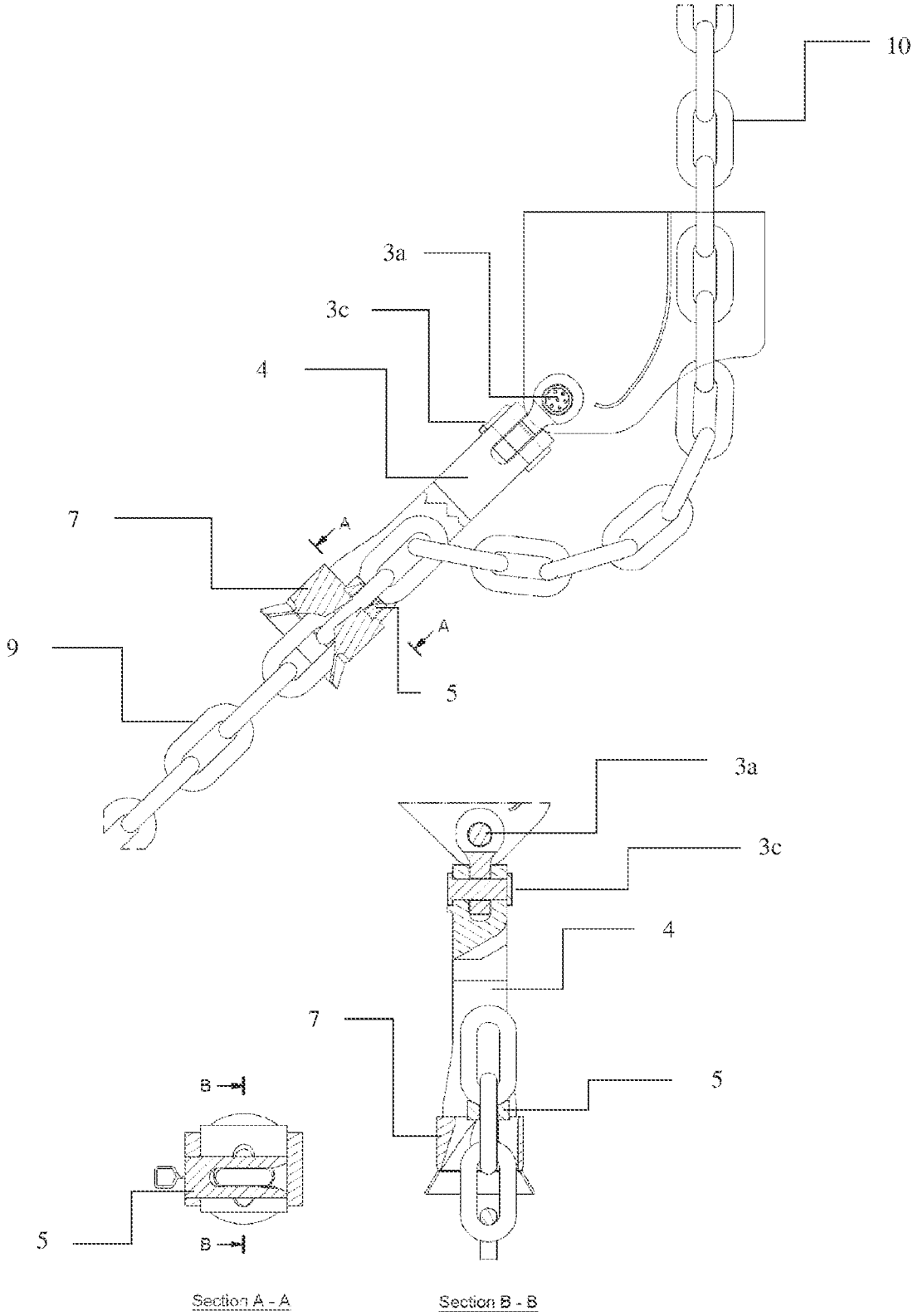
Fig. 8a, b and c

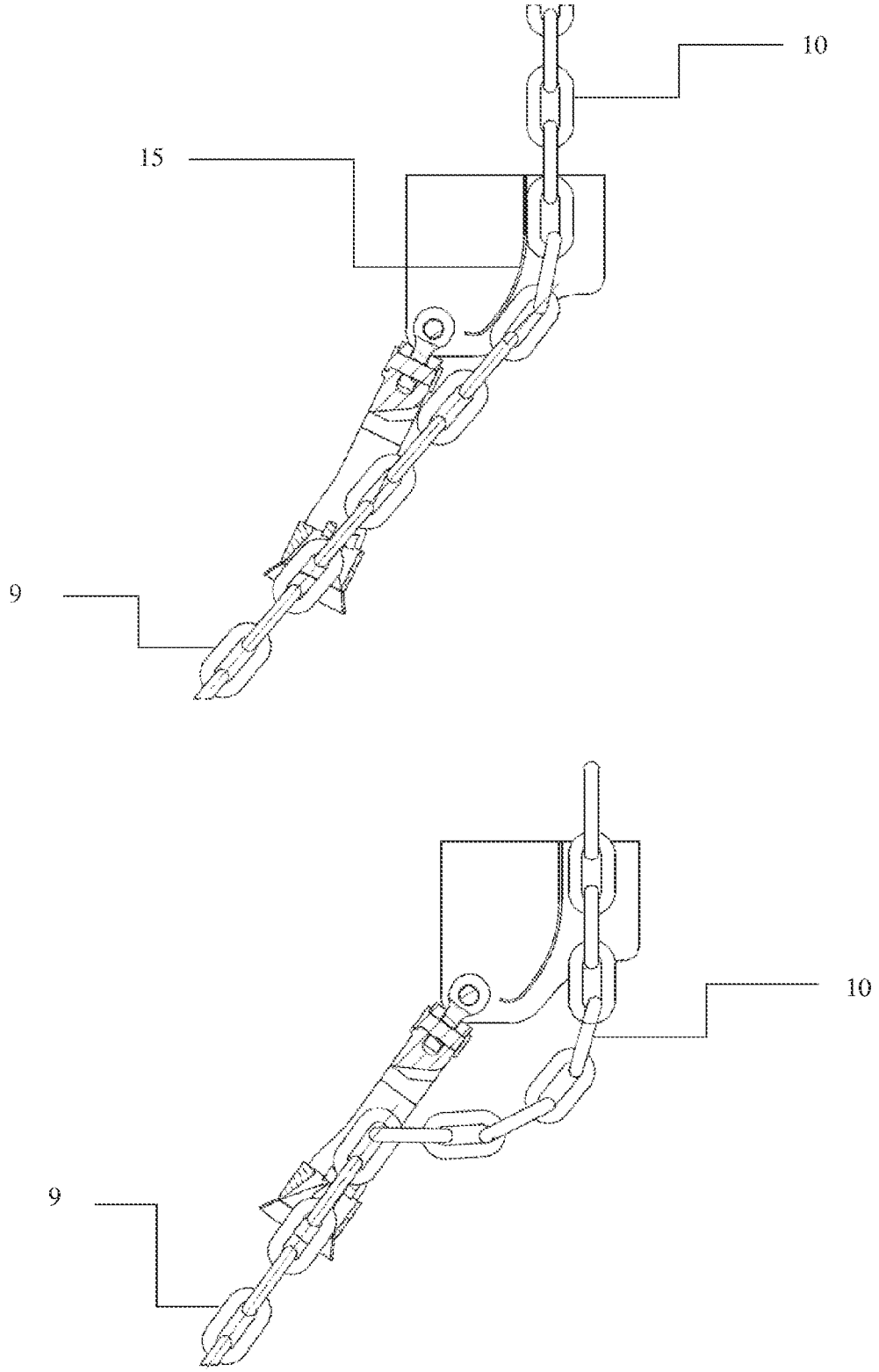
Fig. 8d and e

DUAL AXES CONNECTION DEVICE

CROSS-REFERENCE TO RELATED APPLICATIONS

This patent application is the U.S. National Stage of International Patent Application No. PCT/NO2019/000021, filed Jun. 17, 2019, which claims the benefit of Norwegian Patent Application No. 20180854, filed Jun. 19, 2018, which are each incorporated by reference.

TECHNICAL FIELD

The present invention relates to offshore mooring systems. More specifically it relates to a connection system between a mooring line and an earth-fixed structure or a floating vessel, where the connection system provides a dual axis hinge.

BACKGROUND

Mooring lines are typically connected to a structure on the seabed (anchor) at one end and to a floating body or vessel at the other end. Especially towards the floating vessel the connection preferably needs to provide a dual axis hinge (typically two axes rotated 90 degrees relative each other) to avoid excessive loading and wear of the mooring components from the relative motion between the floating vessel and the mooring line. Some mooring line designs may also require a dual axis connection towards the seabed due to similar relative motions, such as mooring lines for deep water applications, where the complete mooring line is lifted of the seabed in all conditions. It is also beneficial that the hook-up of the mooring line can be done diver less and that the connection can provide an easy way to disconnect and reconnect a mooring line during the life time, e.g. in case a mooring line needs to be repaired or replaced due to damages. A dual axis hinge is especially important if the connection is towards a chain segment of the mooring line, because chain is sensitive to wear, tear and fatigue, and increased degree of rotational freedom in the connection will improve the situation for the chain.

Related prior art is disclosed in U.S. Pat. No. 5,845,893, US20010029878A1, U.S. Pat. No. 7,240,633B2, US201000175604A1, U.S. Pat. No. 7,926,436B2, US20120031320A1, US20120160146A1, WO2014339485A1, WO20160687717A1 and WO2016118006A1.

The present invention solves some of the mentioned problems. Further, the loading on the connection device is reduced when the mooring line is pulled up/tightened because the funnel follows the movements of the chain and the connection device is relieved of all forces originating from the anchor line. When the line is fixed for an anchored position the connection device follows the anchor line and transfers only the pull of the anchor line to the floating body.

The connection device shall also manage a diver less connection and disconnection of the mooring line from the body with the attached connection device.

SHORT SUMMARY OF THE INVENTION

The invention describes a dual axes connection device for use with a mooring line, a line guide and pulling means for connecting a floating body and a fixed body. The mooring line, the line guide and the connection device are positioned in one plane. The connecting device comprises a dual axes hinge unit, with orthogonal rotational axes x and y, and means for fastening the unit to the floating or fixed body. The connection device further comprises a connecting link fastened to the hinge unit, a funnel enveloping the mooring line, and locking means for locking the mooring line to the funnel. The invention is characterized by the connecting link comprising two parallel arms, and the funnel being rotationally connected to the two parallel arms by means of trunnions and mating formations in the outer ends of the two arms.

Furthermore the invention describes two uses of the connection device wherein: a) the hinge unit of the connection device is connected to a floating body with pulling means temporarily or permanently onboard the floating body and the guiding structure temporarily or permanently fixed to the floating body, and b) the hinge unit of the connection device is connected to the mooring anchor, the guiding structure is fixed to the mooring anchor and the pulling means are on board an auxiliary vessel or temporarily attached to the mooring anchor

BRIEF DESCRIPTION OF THE FIGURES

Below, various embodiments of the invention will be described with reference to the figures, in which like numerals in different figures describes the same features

FIGS. 6*a, b* and *c* show a fixing device from a top view, a vertical section and horizontal section.

FIGS. 7*a* and *b* show a connection device connected to an anchor in a pulling state and locked state.

FIG. 8*a-e* show a connection device with a fixed funnel instead of a hinged funnel.

DETAILED DESCRIPTION OF PREFERRED EMBODIMENTS

Figure 1:
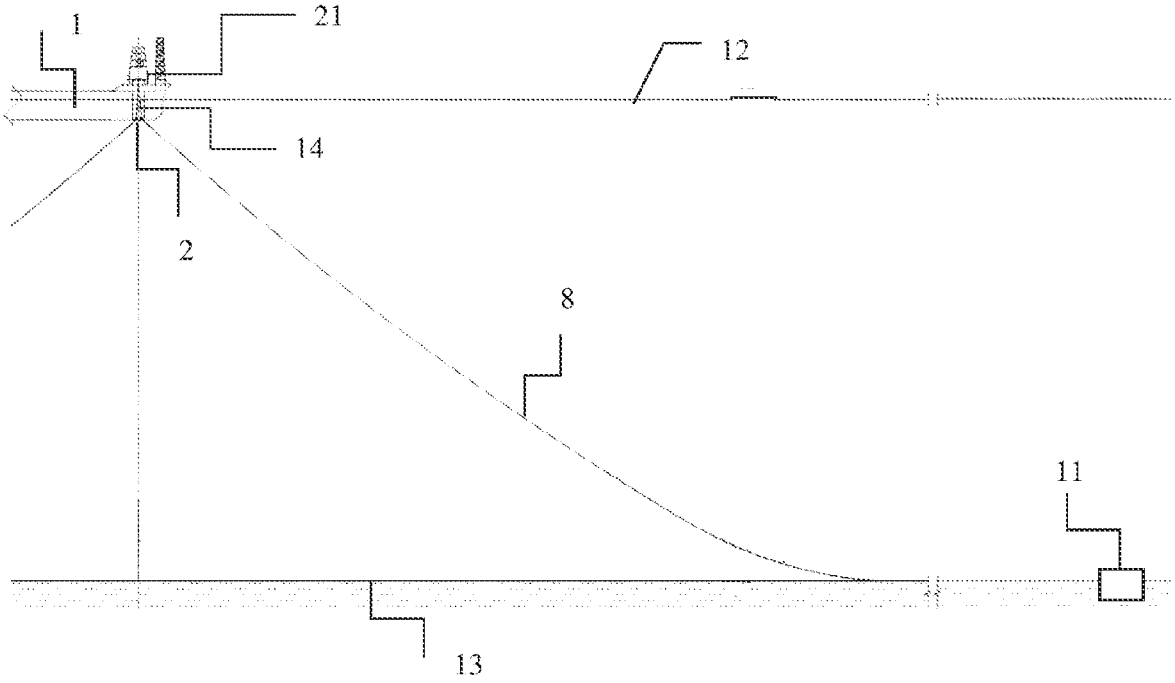
FIG. 1 shows a typical general arrangement of a moored unit with its mooring lines.

This invention describes a dual axes mooring connection device 2 for managing a mooring line 8, comprising, in one embodiment, a first line section 9 extending between a fixed body 11 on the seafloor and the connection device 2 attached to a floating body 1, or vice versa, and a second line section 10 extending between the connection device 2 and pulling means 21 like a winch on the floating body or an auxiliary vessel using a winch or its bollard pull. The first and second sections 9, 10 of the mooring line are defined by their position relative to the connection device when the mooring line is in a locked state.

The main difference from earlier dual axes connection devices is that the device according to the invention is not handling the forces associated with a directional change of the mooring line when the mooring line is winched. These forces are absorbed by a guide structure 15 guiding the second section 10 of the mooring line 8 towards the pulling means 21 making it easier to locate and design the guiding structure 15 and thus make the guiding structure simple and robust for both short-term and long-term use. The connection device itself is only handling pull in the direction of the mooring line when in a locked state.

In order to ease the explanation we use an axis system with x and y axis being perpendicular to the z axis, which is going through the centerline of the connection device 2 when taught. The mooring line is located in a vertical plane that includes the z-axes. Obviously the mooring line 8 will deviate somewhat from this condition due to currents and wave action. In the figures we have chosen the x-axis to be parallel to the rotational axis of the trunnions (explained below) and perpendicular to the mentioned vertical plane, while the y- and z-axes largely resides in the vertical plane. We will use the words inner and outer when describing the connection device, where outer is on the side towards the first section 9 of the mooring line 8 and inner is the side connected to the floating or fixed body. Normally the fixed body would be an anchor. We will also use line and chain interchangeably to describe the mooring line.

FIG. 1 gives an overall view of the arrangement using the mooring connection device 2 according to the invention. In this embodiment the anchor line 8 can be of any type, such as chain, steel wire rope or synthetic rope, but the section 9 towards the connection device 2 is chain. Operation of the connection device can be performed by pulling the second chain section 9 with pulling means 21, such as a winch onboard the floating body 1. An auxiliary vessel on the sea surface 12 in combination with an ROV (Remotely Operated Vehicle) is also in most cases needed for connecting the line on the winch to the mooring line 8 via the connection device 2 when setting up the mooring. The pulling means, such as the said winch, may also be located on another unit, but the pull is via a guiding structure 15 close to the inner side of the connection device 2. The mooring connection device can also be located on an earth-fixed structure (body), such as a mooring anchor 11 on the sea floor 13. The winch will then typically be onboard an auxiliary vessel on the sea surface 12.

Figure 2:
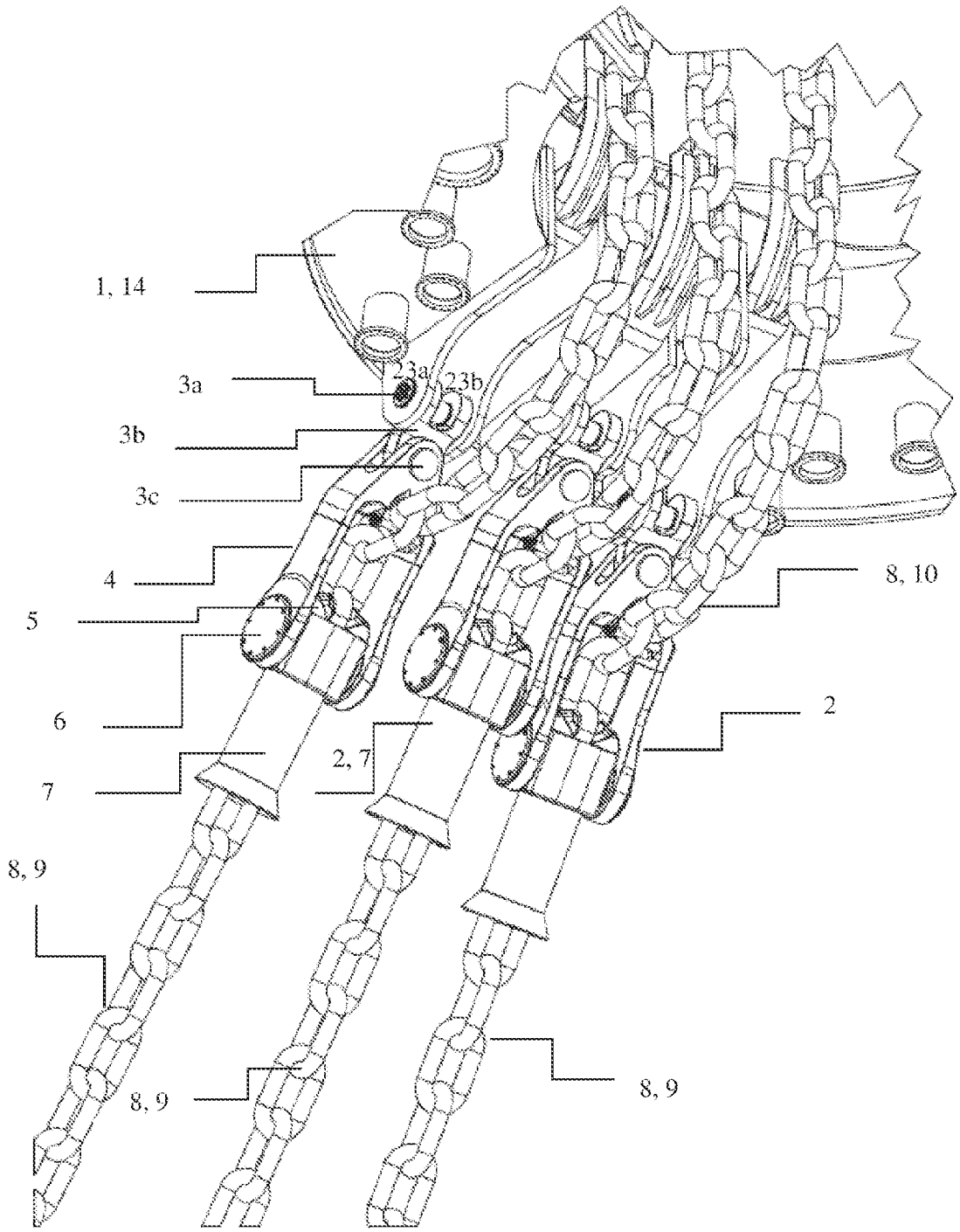
FIG. 2 shows the general arrangement of the connection device and interfacing components/structures.

FIG. 2 shows three mooring connection devices 2 connected to three mooring lines 8 in a taught and locked state. This is a common configuration associated with turrets. The mooring connection device comprises a dual axes hinge unit 3, which in turn comprises an inner connecting link 3*b* with a single axis hinged joint obtained with an x-pin 3*a* connected to a floating body 1 (such as a moored vessel 1, either directly to the hull of the vessel or via a turret 14) or an earth-fixed body (such as a mooring anchor 11). The hinge unit further comprises a y-pin 3*c* rotating around the y-axis. The connection device 2 further comprises an outer connecting link 4 connected to the inner connecting link 3*b* by means of the y-pin 3*c*. The axis of rotation obtained by pin 3*c* is perpendicular to the axis of rotation obtained by pin 3*a*, thus providing two degrees of rotational freedom for the connection device. It is possible to lock the connection device 2 to the chain by chain locking means 5 provided on the funnel 7. When locked, the second chain section 10 of the mooring line 8 is hanging with enough slack to obtain the targeted dual direction angular working envelope of the connecting device 2 with only limited load variations in chain section 9 caused by chain section 10.

Figure 3:
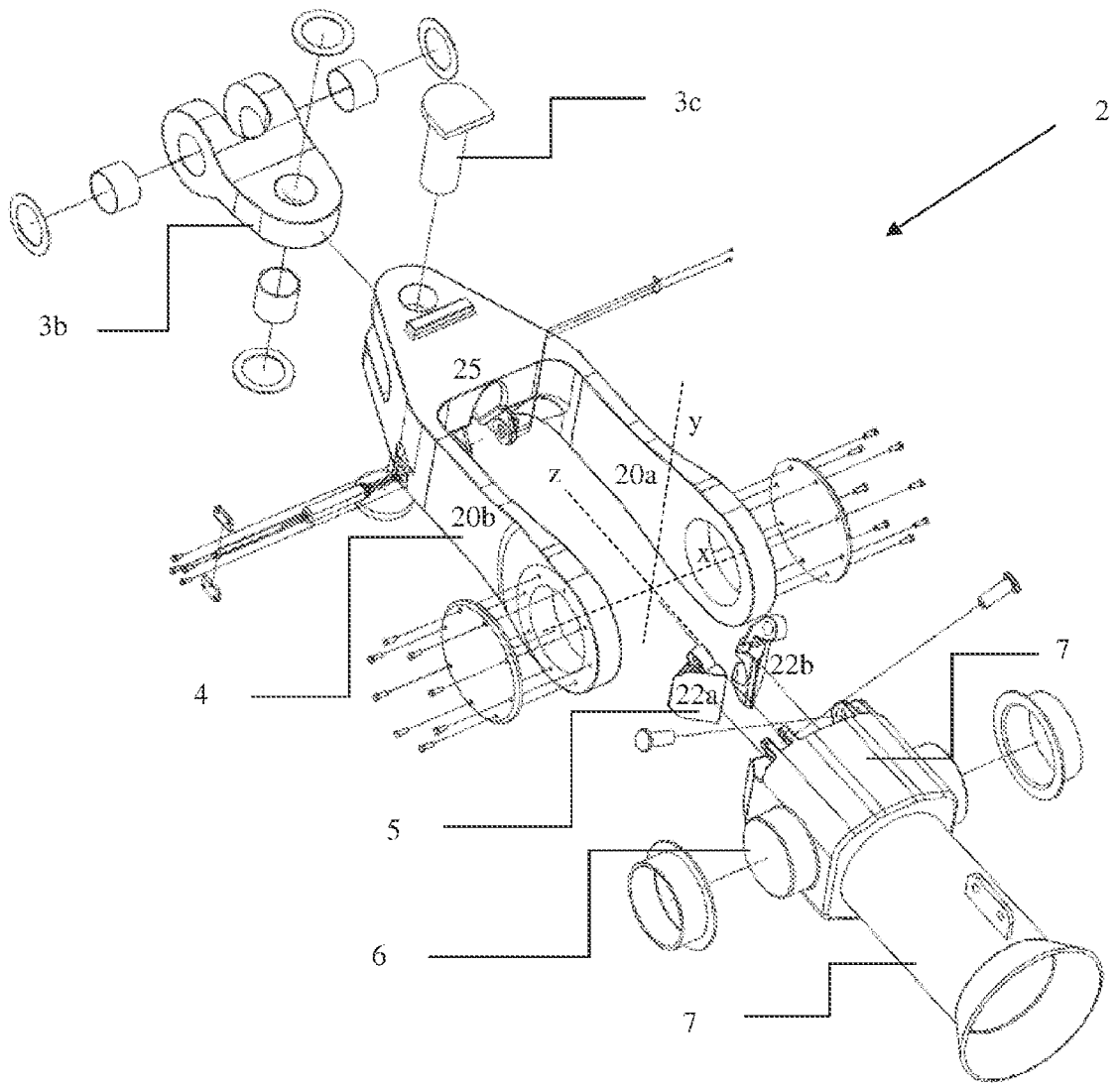
FIG. 3 shows the assembly of the connection device (presented with an exploded view).

FIG. 3 shows an exploded view of an embodiment of the connection device 2 with all the main components. The inner end of the connection device 2, which normally is attached to the floating body 1, comprises a dual axis hinge unit 3 which in this embodiment comprises an inner connection link 3*b* with an x-pin 3*a* rotating around the x-axis in the mentioned axis system. The x-pin 3*a* is fastened to the floating body by means of two eyes 23*a, b* as shown in FIG. 2. The inner connection link 3*b* is further rotationally connected to an outer connecting link 4 via a y-pin 3*c*, which has an axis of rotation around the y-axis of the mentioned axis system indicated in this figure by dotted lines. The invention does also work with the same functionalities if the said x-pin and y-pin switch position, i.e. the y-pin is towards the body and the x-pin is towards the outer connecting link. The x-pin and the y-pin can also be arranged as a cardan joint.

The outer connecting link 4 comprises two parallel arms 20*a, b* connected to a funnel 7 in their outer ends. The funnel envelopes the mooring line 8,9 and has in the shown embodiment integrated chain locking means 5. The purpose of the funnel is to guide the connection device in an orientation suitable for locking the mooring line. Different chain and line locking solutions are well known and the options are numerous. Hooks, wedges, clamps and pins may be used on a chain, and clamps splices, knots and wedges or a combination of those may be used for wires and ropes and their terminations.

In the embodiment shown in FIG. 3 the locking means comprise two hinged identical, but mirrored chain locking components 22*a, b* fitting into mating formations at the inner end of the funnel and having a distance between them that allows a link in the chain in a given orientation to pass, but locking the next link which is oriented close to 90 degree relative to the first mentioned link and thus preventing the mooring line from being pulled out of the connecting device in an opposite direction of the main pull-direction. The components may further comprise grooves that mate with a link in the chain. In one embodiment the locking components 22*a, b*, are pre-tensioned to provide self-engagement after tightening the mooring line.

The funnel 7 has in one embodiment a rotational freedom relative to the outer connecting link 4, which is obtained by trunnions 6 and interfacing structure in arms 20*a,b* of the outer connecting link 4. In a configuration wherein the mooring line is not subjected to large movements, the funnel 7 can also be fixed to the arms 20*a,b* of outer connecting link 4 without any rotational freedom as shown in FIG. 8, but then the inside shape and length of the funnel must be arranged such that the chain is not subject to bending loads when the chain is fully connected by the locking elements 5 and not subject to bending loads during the chain pull-through operation. The length of the arms 20*a, b* should be such that the mooring line 9 connected to the funnel 7 at the opposite end of the arms from base 25 do not suffer excessive wear and stresses due to combined tension and angular motions of the line. In the case of the mooring line being a chain, it would typically mean at least the length of two links in the chain.

Figure 4:
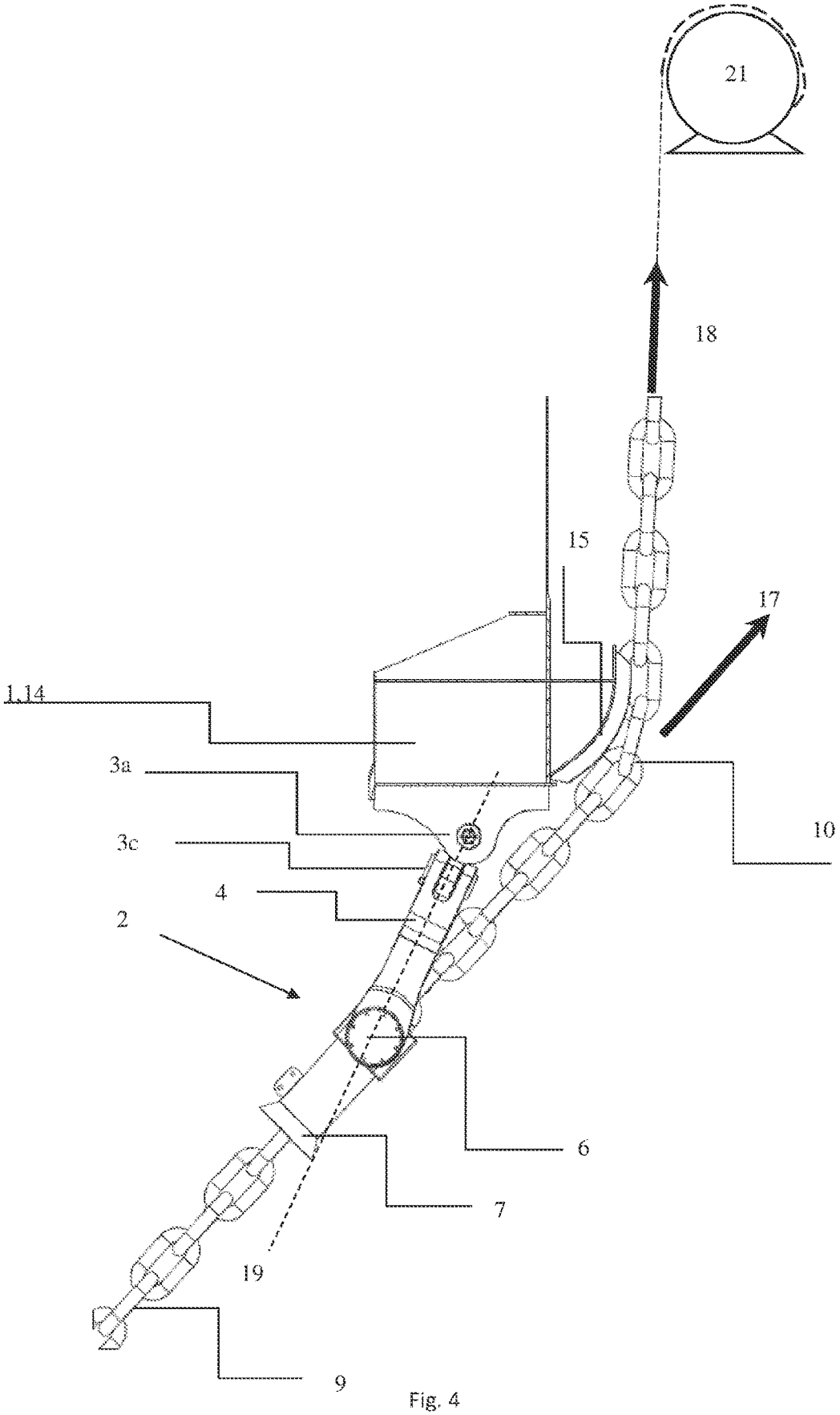
FIG. 4 shows the pull-through operation of the chain, where locking element(s) are not activated.

FIG. 4 shows the chain pull-through situation, where a main chain pull-direction 17 forces the outer connecting link 4 in a direction 19 that differs from the pull-direction 17 and the orientation of the line section 9. The funnel 7 rotates about the trunnions 6 such that it aligns with the pull-direction 17 and the orientation of the line section 9 at the position of the funnel. This allows the connection device 2 to remain in contact with the chain and remain available for locking of the chain to the funnel 7, while all anchoring load is taken up by the chain section 9 and 10. The floating body 1 or fixed body 11 is fitted with a chain guide 15 that allows a secondary pull-direction 18 of the upper end of chain section 10, without affecting the main pull-direction and the orientation of the chain section 9.

The mooring line 8, the guide structure 15 and the z-axis of the connection device 2 must roughly be in the same plane, usually a vertical plane. This implies that the connection device will only function when the mooring line is within a given sector in relation to the guide structure 15. The possible deviation from the vertical plane is limited, but can be increased if rotational means rotating around the y-axis are fitted to the funnel 7 close to the rotation around the x-axis provided by the trunnions 6. In another embodiment rotational means for rotation around the z-axis is provided close to the dual axes hinge unit 3. This will have same effect as the said rotational means near the trunnions. If additional rotational means are fitted to the funnel 7 the mentioned sector could approach 90 degrees. In a typical configuration such freedom of movement is not required and hence a connection device without such additional rotational means will suffice.

Furthermore the connection device 2 must be mounted a distance away from the position of the mooring line 8 when it is pulled by the pulling means 21. This distance must obviously be less than the length $L_{cd}$ of the connection device 2 from the inner end to the trunnions, but large enough to provide an angle between the connection device and the mooring line such that the mooring line is moving freely between the parallel arms 20*a, b* and do not interfere with the outer connecting link when the mooring line is in its tightest state. Also the connection device must be mounted close to the guide structure 15, preferable less than $L_{cd}$ such that the connection device is less vulnerable to deviations from the mentioned vertical plane and also are able to handle slacker states of the mooring line when the mooring line is approaching vertical (or horizontal if connected to an anchor). A typical positioning would be ½ $L_{cd}$ from the guide structure and ⅓ $L_{cd}$ at a right angle from the taught mooring line. However, if the deviations in position of the mooring line is small, the distance between the guide structure and the connection device 2 may be bigger.

Figure 5:
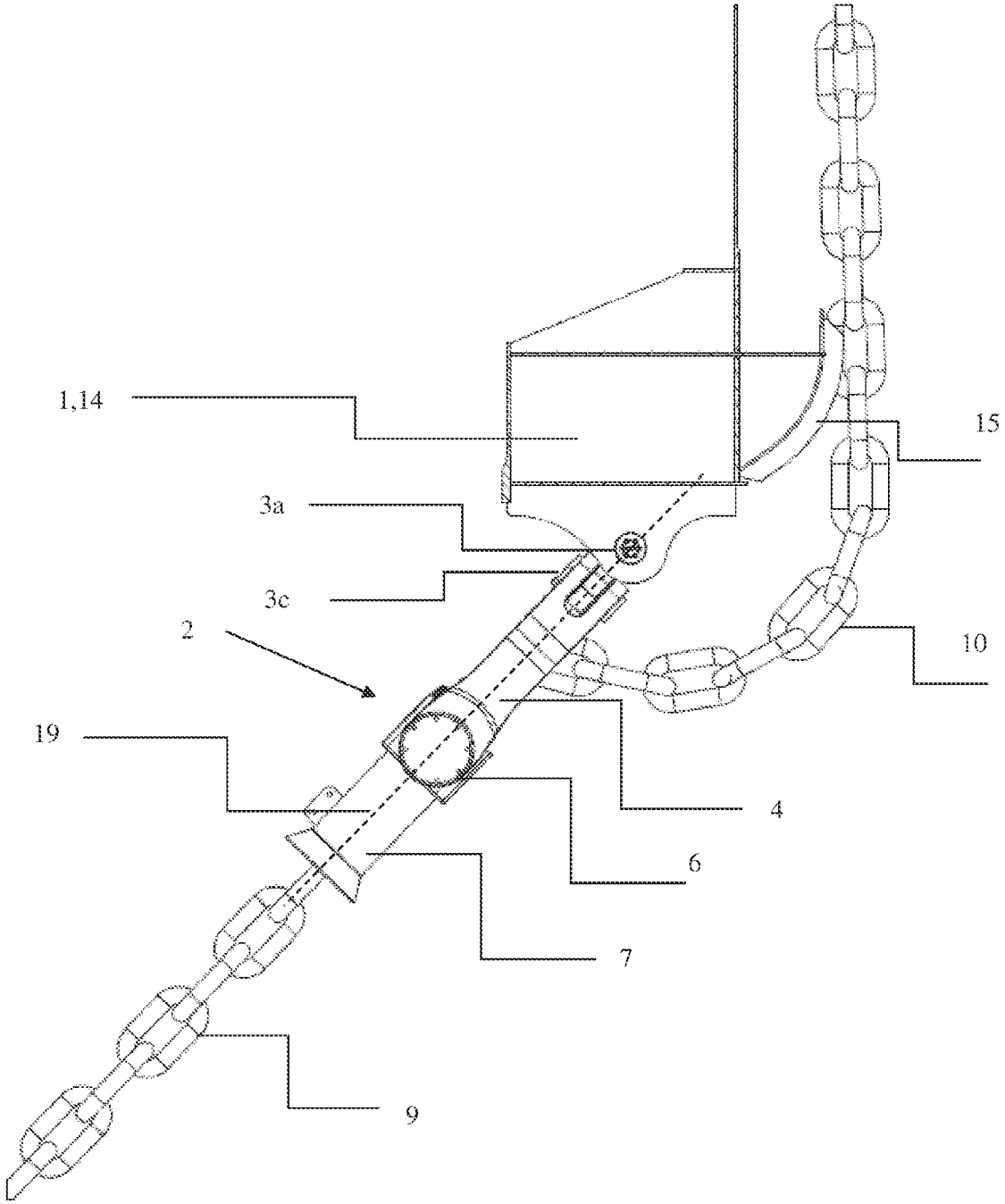
FIG. 5 shows the general arrangement of the connection device after the pull-in operation has been completed, and locking device(s) have been activated.

FIG. 5 shows a situation where the pull-through operation has been completed and the chain locking means 5 have been activated. The second chain/line section 10 is then slack, and all the loads from the mooring line is going via the first chain section 9 and is transferred via the connection device 2 into the fixed body 11 or floating body 1,14.

When the mooring line 8 is to be disconnected from the fixed or floating body the second chain section 10 must be tensioned up to a level such that all the loads from chain section 9 is transferred into the second chain section 10, and not the connection device 2. At this stage the locking means 5 can be released, preferably with the help of an ROV, and thus allowing the chain to be let out through the connection device.

The above description and associated drawings refers to a device connected to a mooring line 8, where the first section 9 and second section 10 are chain. Same principals and functionality also applies to mooring lines where these sections are not chain. If the first section 9 of mooring line 8 is something else than chain then the upper end of the mooring line 9 will have a line locking component attached to the end that can mate with the locking means 5 on the funnel 7 and be locked to the funnel, confer example in FIG. 6. Line locking components of different kinds are available technology and will not be described closer. A pull line can also replace the second chain section 10, and when the first section 9 is locked to funnel 7 via locking means 5 the pull line or second section 10 can be removed.

FIGS. 4 and 5 shows the guiding structure 15 as a fixed guiding structure on a floating body 1, 14. Alternatively, means of guiding the second line section 10 can be a permanent or temporary sheave arrangement attached to the floating body 1, the mooring anchor 11 or the turret 14.

FIG. 6*a, b* and *c* show a top view, a vertical section and a horizontal section of a fixing device 24 for connecting the first section 9 with the second section 10 and also locking it to the funnel. The fixing device 24 comprises a fixed line side 25 and a pulling side 26 with a fastening means in each end for fixing to the respective first and second sections 9, 10. In the embodiment shown in FIG. 6 the fixed line side 25 has a pin suitable for attachment to an eye in a steel wire rope socket, thimble for a synthetic rope or similar. For a steel wire rope the fixing device 24 can also be an integrated part of the wire rope socket. The fastening means on the pulling side 26 has a shape that locks a mating shape attached to the end of the second section 10. Preferably the funnel and fixing device has mating conical surfaces. This ensures that when the first section, with the fixing device 24 attached, is pulled into the funnel the fixing device will stop at a predetermined position. Preferably such that locking means 5 for fixing the fixing device to the funnel can be activated. The embodiment shown in FIG. 6 shows that the locking means 5 are two fixing pins 28 mating with a fixing groove 27 in the fixing device, wherein the fixing pins are operated by fixing pin insertion means 29. The fixing pin insertion means should be operable by a ROV. When using a fixing device 24 as described the length of the first section 9 is to some extent fixed. In many installations this is acceptable and a more stable connection with less wear is obtained In one use of the connection device, the hinge unit 3 of the connection device is connected to a floating body 1 with pulling means 21 temporarily or permanently onboard the floating body and the guiding structure 15 temporarily or permanently fixed to the floating body. An example of this setup is shown in FIGS. 4 and 5.

In another use of the connection device the hinge unit 3 of the connection device is connected to the mooring anchor, the guiding structure 15 is fixed to the mooring anchor and the pulling means are on board an auxiliary vessel or temporarily attached to the mooring anchor. An example of this setup is shown in FIGS. 7*a* and *b*. 7*a* shows the mooring line being tightened and 7*b* shows the device and mooring line in a locked state. Section 9 in this setup leads to a floating device and section 10 leads to pulling means most commonly located on an auxiliary vessel.

FIG. 8*a-e* show a funnel 7 without trunnions 6 being fixed to the parallel arms 20*a, b*. Preferably, if the line is not a chain, the funnel is short and has an inside guide structure like a rounded double cone with an apex angle similar to the angle between vertical and the expected mooring line position at the location of the funnel (allowing the mooring line to be pulled in a straight line, or close to a straight line, through the funnel, when the longitudinal axis of the connecting link 4 and the integrated funnel 7 is not parallel with the main pull direction 17 of the mooring line).

In another embodiment, when the line 8 is a chain, the inner guide structure of the funnel has the shape of a cross giving room for the two orientations of the links as illustrated in FIG. 8*a-e*. FIG. 8*a* shows the mooring line in a taught state with the line/chain locked in the funnel. FIG. 8*b* is a section along the x-y plane of the connection device at the height of the locking means 5 and shows the locking means 5 in a locked state. FIG. 8*c* is a section in the y-z plane showing the locking means in a locked state. FIGS. 8*d* and *e* shows the chain 8 in a pulling state and a taught state respectively. FIGS. 8*a* and *d* also illustrate how the funnel must be shaped to handle the different angles between the connection device and the mooring line. The inner side of the funnel 7 which is the furthest away from the guiding structure 15 is widening towards the outer end of the funnel.

REFERENCE NUMERALS

1 Moored vessel/floating body
2 Dual axes connection device
3 Dual axes hinge unit
3*a* X-Pin of hinge unit 3
3*b* Inner connecting link
3*c* Y-Pin of hinge unit 3
4 Outer connecting link
5 Locking means on funnel
6 Trunnions on funnel for rotational freedom between funnel and outer connecting link
7 Funnel
8 Mooring line,
9 First line/chain section
10 Second line/chain section
11 Mooring anchor
12 Sea surface
13 Sea floor
14 Turret
15 Guiding structure for chain
16 Pull-direction during hook-up of chain
17 Main pull-direction of the chain
18 Secondary pull-direction of the chain
19 Longitudinal axis of outer connecting link
20*a, b* Parallel arms of connecting link 4
21 Pulling means, such as a winch
22*a, b* Locking components
23*a, b* Connection eyes
24 Fixing device
25 Fixed line side
26 Pulling side
27 Fixing groove
28 Fixing pin(s)
29 Inserting means for fixing pins

The invention claimed is:

1. A dual axes connection device for use with a mooring line, a guide structure and pulling means for connecting a floating body and a fixed body, wherein the guide structure is a fixed guide structure on the floating body, and wherein the mooring line, the guide structure and dual axes connection device are positioned in one plane and wherein the dual axes connecting device comprises:

a dual axes hinge unit, with orthogonal rotational axes x and y, comprising means for fastening the dual axes hinge unit to the floating or the fixed body, a connecting link fastened to the dual axes hinge unit, a funnel enveloping the mooring line, and locking means for locking the mooring line to the funnel, the funnel having an inner end, wherein the connecting link comprises two parallel arms each having outer ends, and the funnel being rotationally connected to the two parallel arms by trunnions and mating formations in the outer ends of the two arms, wherein the locking means are two hinged identical mirrored chain locking components fitting into mating formations at the inner end of the funnel and having a distance between the two hinged identical mirrored chain locking components preventing the mooring line from being pulled out of the dual axes connection device in an opposite direction of a main pull-direction.

2. The dual axes connection device according to claim 1, wherein the mooring line is a chain, wire or rope.

3. The dual axes connection device according to claim 1, wherein the locking means are pre-tensioned and self-engaging when tension of a second line section of the mooring line is relieved.

4. The dual axes connection device according to claim 1, wherein the connecting link is connected to the dual axes hinge unit with rotable means such that the funnel will follow the direction of the mooring line independent of the connecting link.

5. The dual axes connection device according to claim 1, further comprising a first line section of the mooring line extending between a fixed body on a seafloor and the connection device attached to a floating body, or vice versa, and a second section of the mooring line extending between the dual axes connection device and pulling means, wherein the dual axes connection device comprises a fixing device comprising: a pulling side and a fixed line side each with fastening means for the first and second sections of the mooring line respectively; the locking means for locking the fixing device to the funnel.

6. The dual axes connection device according to claim 5 wherein the funnel and the fixing device each have mating conical surfaces.

7. A method of connection a dual axes connection device to a floating body, the method comprising:

connecting the dual axis hinge unit of the dual axes connection device of claim 1 to the floating body, wherein a pulling means for pulling the mooring line is onboard the floating body, and a guide structure for guiding the mooring line is fixed to the floating body.

8. A method for connection a dual axes connection device to a mooring anchor, the method comprising:

connecting the dual axis hinge unit of the dual axes connection device of claim 1 to a mooring anchor, wherein a pulling means for pulling the mooring line is onboard an auxiliary vessel or temporarily attached to the mooring anchor, and a guide structure for guiding the mooring line is fixed to the mooring anchor.

* * * * *